US010888209B2

(12) United States Patent
Durrant et al.

(10) Patent No.: US 10,888,209 B2
(45) Date of Patent: Jan. 12, 2021

(54) VACUUM PATHWAY IN A CLEANING DEVICE

(71) Applicant: Harris Research, Inc., Logan, UT (US)

(72) Inventors: Edward E. Durrant, Paradise, UT (US); Dale S. Jensen, Smithfield, UT (US); Craig L. Donaldson, Logan, UT (US); Roger C. Andersen, Logan, UT (US); Monte G. Taylor, Logan, UT (US)

(73) Assignee: Harris Research, Inc., Nashville, TN (US)

( * ) Notice: Subject to any disclaimer, the term of this patent is extended or adjusted under 35 U.S.C. 154(b) by 0 days.

(21) Appl. No.: 13/621,746

(22) Filed: Sep. 17, 2012

(65) Prior Publication Data

US 2013/0067683 A1 Mar. 21, 2013

Related U.S. Application Data

(60) Provisional application No. 61/535,684, filed on Sep. 16, 2011.

(51) Int. Cl.

| | |
|---|---|
| ***A47L 9/02*** | (2006.01) |
| ***A47L 11/40*** | (2006.01) |
| ***A47L 11/34*** | (2006.01) |

(52) U.S. Cl.

CPC ..... *A47L 11/40* (2013.01); *A47L 11/34* (2013.01)

(58) Field of Classification Search

CPC ..... A47L 11/20; A47L 11/201; A47L 11/206; A47L 11/293; A47L 11/30; A47L 11/302; A47L 11/40; A47L 11/34

USPC ..... 15/320, 415.1

See application file for complete search history.

(56) References Cited

U.S. PATENT DOCUMENTS

| | | | | |
|---|---|---|---|---|
| 3,964,925 | A * | 6/1976 | Burgoon | A47L 11/34 134/21 |
| 4,000,538 | A * | 1/1977 | Tissier | A47L 11/305 15/320 |
| 4,380,844 | A * | 4/1983 | Waldhauser | A47L 11/30 15/320 |
| 4,441,229 | A | 4/1984 | Monson | |
| 6,032,326 | A * | 3/2000 | Roden | A47L 9/02 15/320 |
| 6,266,892 | B1 * | 7/2001 | Haynie | A47L 7/0009 34/229 |
| 2006/0143843 | A1 | 7/2006 | Benedict | |
| 2007/0251047 | A1 * | 11/2007 | Monson | A47L 11/03 15/322 |

(Continued)

OTHER PUBLICATIONS

PCT/US2012/055798, International Search Report and Written Opinion.

*Primary Examiner* — Brian D Keller

(74) *Attorney, Agent, or Firm* — Jacob W Neu; Bradley Arant Boult Cummings, LLP

(57) ABSTRACT

A cleaning apparatus is disclosed for extracting a liquid from a surface. The apparatus includes at least one extraction head that has at least one aperture that is facing the surface to be cleaned. The vacuum cleaner includes a vacuum pathway situated between the at least one extraction head and a riser that is connected to a vacuum motor. The internal surfaces of the vacuum pathway are smooth and the vacuum pathway has certain dimensions and orientations that optimize the extraction of a liquid from a surface.

18 Claims, 7 Drawing Sheets

(56) References Cited

U.S. PATENT DOCUMENTS

| | | | | |
|---|---|---|---|---|
| 2008/0141483 | A1* | 6/2008 | Pearlstein ..... | A47L 11/34 15/320 |
| 2009/0078290 | A1 | 3/2009 | Addicks et al. | |

* cited by examiner

VACUUM PATHWAY IN A CLEANING DEVICE

CROSS-REFERENCES TO RELATED APPLICATIONS

This application claims the benefit of U.S. Provisional Patent Application No. 61/535,684 entitled "VACUUM PATHWAY IN A ROTARY HEAD CLEANER" and filed on Sep. 16, 2011 for Edward E. Durrant et al., which is incorporated herein by reference.

FIELD

This disclosure relates to floor cleaning devices and more particularly relates to vacuum pathways of cleaning devices.

BACKGROUND

The cleaning of carpet, to remove stains, dirt, etc., is achieved using various different methods, including dry-cleaning techniques, wet-cleaning techniques, and vacuuming. Wet-cleaning, or steam cleaning as it is commonly known, is a technique that involves spraying heated water onto carpet, agitation of the carpet, and extraction of the heated water. The extraction step may require several passes with a cleaning tool to extract water from the carpet before allowing the carpet to air-dry.

Unfortunately, many of the conventional cleaning tools used to extract water from the carpet are bulky, cumbersome and inefficient. Thus, even after several passes with the cleaning tool, a substantial amount of water remains in/on the carpet and the carpet must be left to air-dry for many hours. Furthermore, motors that provide the vacuum suction to the cleaning tool are often located remotely, and therefore suffer from a loss of suction power over the length of the suction hose.

SUMMARY

From the foregoing discussion, it should be apparent that a need exists for an apparatus that extracts a greater amount of water from surfaces than conventional vacuum cleaning systems. Beneficially, such an apparatus would include a vacuum pathway optimized for efficiently extracting a liquid.

The subject matter of the present application has been developed in response to the present state of the art, and in particular, in response to the problems and needs in the art that have not yet been fully solved by currently available cleaning systems. Accordingly, the present disclosure has been developed to provide an apparatus for cleaning surfaces that overcome many or all of the above-discussed shortcomings in the art.

The present disclosure relates to a vacuum cleaner that includes at least one extraction head that has at least one aperture that is facing the surface to be cleaned. The vacuum cleaner includes a vacuum pathway situated between the at least one extraction head and a riser that is connected to a vacuum motor. The vacuum pathway may have a cross-sectional area in the range of between about 0.8 square inches and 7.0 square inches.

In one embodiment, the length of the vacuum pathway is in the range of between about 0.25 and 3.0 feet. In another embodiment, the length of the vacuum pathway is in the range of between about 0.75 feet and 2.0 feet. In yet another embodiment, the length of the vacuum pathway is about 1 foot. The internal surfaces of the vacuum pathway may be smooth and the pathway may include at most two 90 degree bends.

The vacuum pathway may also include a tube that is coupled with and disposed between the extraction head(s) and a vacuum chamber. The vacuum chamber is connected with a plenum chamber, which is in turn connected with the riser. The ratio of the cross-sectional area of the vacuum pathway in the plenum chamber to the summed cross-sectional area of all the apertures in the at least one extraction head is about 5 to 1. In another implementation, the ratio of the cross-sectional area of the vacuum pathway in the plenum chamber to one of the cross-sectional areas of the tube, vacuum chamber, or riser is in the range of between about 1.7:1 and 1:1. The vacuum cleaner may also include a rotary head that includes multiple extraction heads. The vacuum cleaner may also include an evacuation tank where the extracted liquids are temporarily contained.

Reference throughout this specification to features, advantages, or similar language does not imply that all of the features and advantages that may be realized with the present disclosure should be or are in any single embodiment of the invention. Rather, language referring to the features and advantages is understood to mean that a specific feature, advantage, or characteristic described in connection with an embodiment is included in at least one embodiment of the subject matter disclosed herein. Thus, discussion of the features and advantages, and similar language, throughout this specification may, but do not necessarily, refer to the same embodiment.

Furthermore, the described features, advantages, and characteristics of the disclosure may be combined in any suitable manner in one or more embodiments. One skilled in the relevant art will recognize that the subject matter of the present application may be practiced without one or more of the specific features or advantages of a particular embodiment. In other instances, additional features and advantages may be recognized in certain embodiments that may not be present in all embodiments of the disclosure.

These features and advantages of the present disclosure will become more fully apparent from the following description and appended claims, or may be learned by the practice of the disclosure as set forth hereinafter.

BRIEF DESCRIPTION OF THE DRAWINGS

In order that the advantages of the disclosure will be readily understood, a more particular description of the disclosure briefly described above will be rendered by reference to specific embodiments that are illustrated in the appended drawings. Understanding that these drawings depict only typical embodiments of the disclosure and are not therefore to be considered to be limiting of its scope, the disclosure will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Thus, appearances of the phrases "in one embodiment," "in an embodiment," and similar language throughout this specification may, but do not necessarily, all refer to the same embodiment.

Furthermore, the described features, structures, or characteristics of the disclosure may be combined in any suitable manner in one or more embodiments. In the following description, numerous specific details are provided to give a thorough understanding of embodiments of the disclosure. One skilled in the relevant art will recognize, however, that the disclosure may be practiced without one or more of the specific details, or with other methods, components, materials, and so forth. In other instances, well-known structures, materials, or operations are not shown or described in detail to avoid obscuring aspects of the disclosure.

Figure 1:
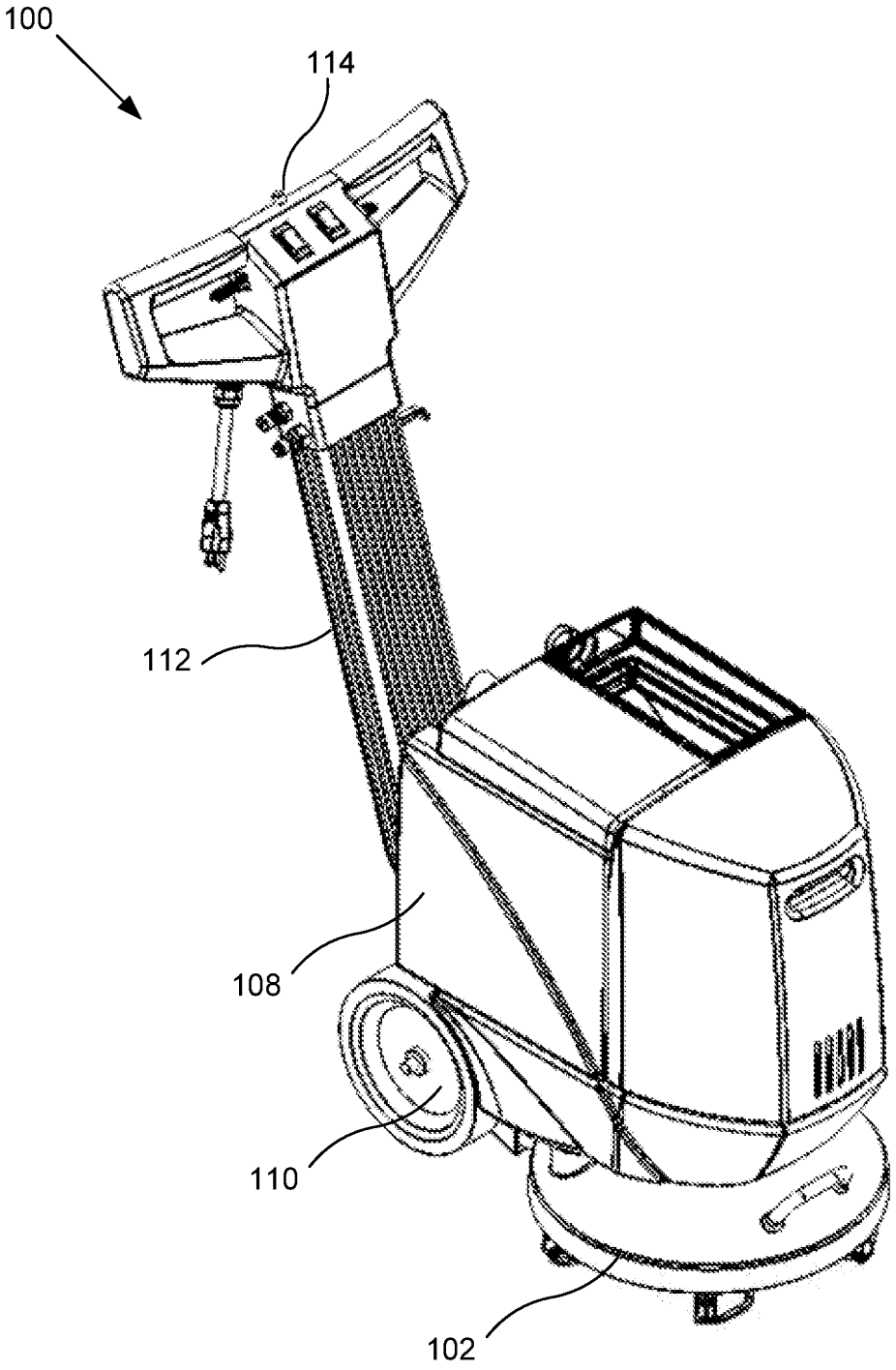
FIG. 1 is a diagram illustrating one embodiment of a rotary head cleaning machine.

FIG. 1 is a diagram illustrating one embodiment of a rotary head cleaning machine 100 (hereinafter "machine 100"). The machine 100, in one embodiment, includes a housing 102 that forms a supportive base for a rotary motor, a vacuum motor, an evacuation tank 108, and an evacuation pump. A pair of wheels 110 and a handle 112 may also be connected to the housing 102. The housing 102, in a further embodiment, is configured having a bell shape to form a protective cover around a rotary head which will be described in greater detail below with reference to FIGS. 2-3.

The housing 102 is formed of a rigid material capable of supporting the rotary motor, vacuum motor, evacuation tank, wheels 110, and handle 112. Examples of a rigid material capable of use in the present disclosure include, but are not limited to, aluminum, aluminum alloys, steel alloys, other metal alloys, and rigid plastics. The rotary motor, in one embodiment, is an electrical motor capable of generating a force sufficient to turn the rotary head. In one embodiment, the rotary motor is a ¾ hp motor. The rotary motor 104 may be connected with a gearbox that transfers the rotary force of the rotary motor through a driveshaft to the rotary head.

The evacuation tank 108 is a storage tank for holding liquid that is extracted from flooring via the extraction heads. The evacuation tank 108 may be formed as an integral piece of the housing 102, or alternatively as a separate component that is attached to the housing 102.

The machine 100 may be powered via an electrical cord for accessing 110 V or 220 V electricity on the premises. Additionally, the machine 100 may be powered by a generator that may be moveable to the premises or which may be located on the truck.

In one embodiment, the electrical characteristics of the machine 100 are selected to keep the electricity usage from exceeding an amount that might exceed the capacity of the power supply. For instance, the rotary motor and the vacuum motor are preferably selected to have a combined current usage within a selected threshold level. In a further embodiment, the evacuation pump is also selected to combine with the rotary motor and the vacuum motor to maintain a current usage within the selected threshold.

In one embodiment, the selected threshold is within the range of between about 10 and about 22 amps. In a further embodiment, the selected threshold is within the range of between about 12 and about 18 amps. In a more specific embodiment, the selected threshold is about 15 amps.

In order to stay within the threshold current usage, power saving configurations may be used. For instance, the heads 201 may be made of a low friction material. In one embodiment, the friction reducing material is polytetraflouroethylene.

In a further embodiment, the machine 100 may be powered by multiple power cords for plugging into different phases of the power source. An indicator 114 positioned on the handle may identify when the multiple power cords are plugged into different phases or electrical circuits.

Figure 2:
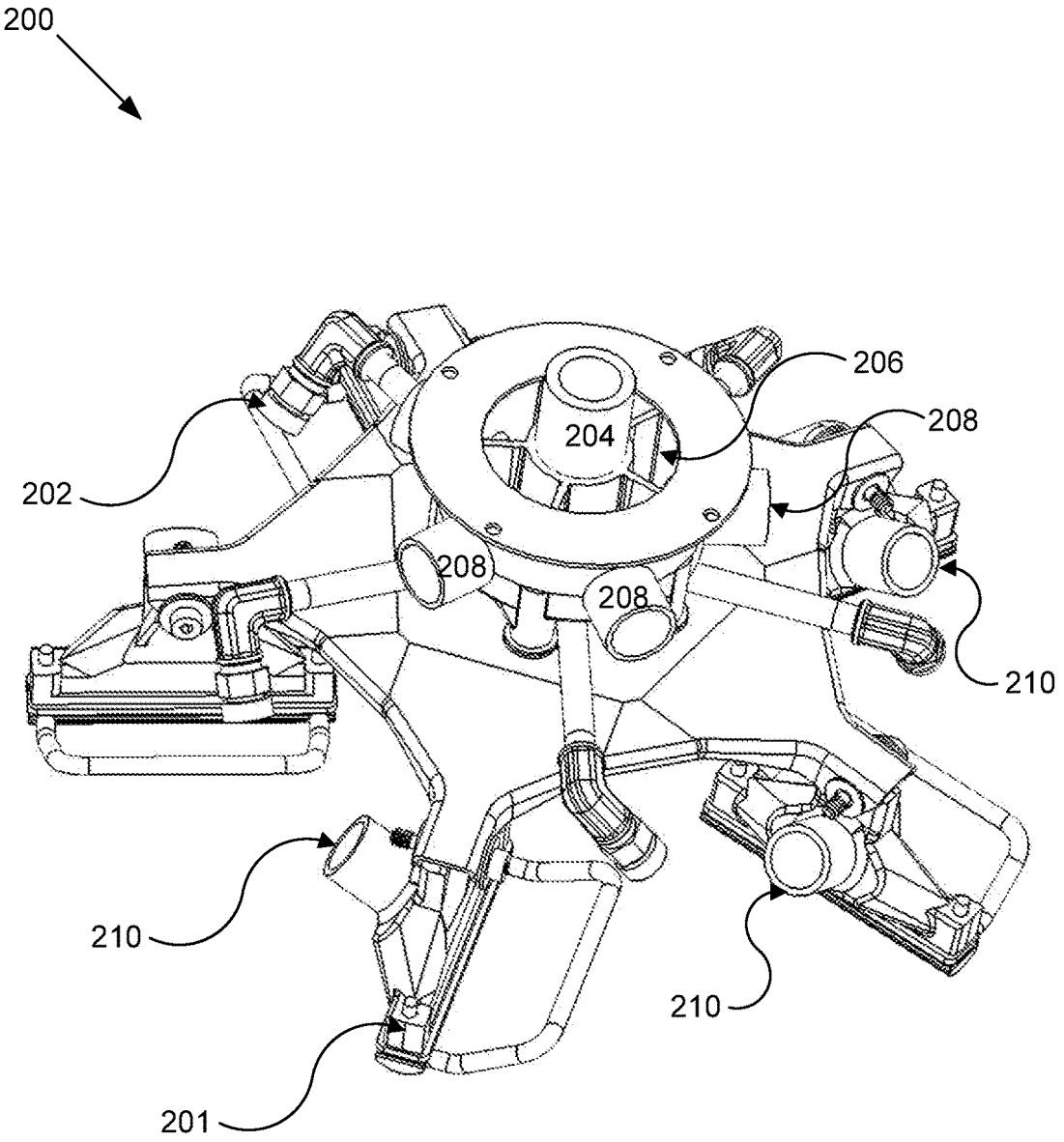
FIG. 2 is a perspective view diagram illustrating one embodiment of the rotary head.

FIG. 2 is a perspective view diagram illustrating one embodiment of the rotary head 200. As described above, the rotary head 200 is coupled with extraction heads 201. The depicted embodiment demonstrates a rotary head 200 having five extraction heads 201. Alternatively, the rotary head 200 may include more or less extraction heads 201 depending on the type of flooring to be cleaned.

The rotary head 200, in one embodiment, includes at least one spray nozzle 202. Alternatively, the rotary head 200 may be configured with multiple spray nozzles 202, each fluidly coupled with a cleaning solution source. The cleaning solution may be a pressurized liquid such as water or a mixture of water and a cleaning agent. The cleaning solution is delivered via a conduit that passes through a hollow driveshaft that connects a gearbox with rotary head 200. The hollow driveshaft will be discussed in greater detail below with reference to FIG. 4.

Concentric with the hollow driveshaft 204 is a vacuum chamber 206 having a plurality of inlets 208. The vacuum chamber 206, in one embodiment, may be sub-divided into smaller chambers. The smaller chambers are each fluidly coupled with the inlets 208. Alternatively, the vacuum chamber 206 may be configured as a single chamber having multiple inlets 208. Each inlet 208 is connected via a hose (not shown) with an outlet 210 of an extraction head 201. The hoses are not depicted here so as to not obstruct the perspective view of the rotary head 200.

Figure 3:
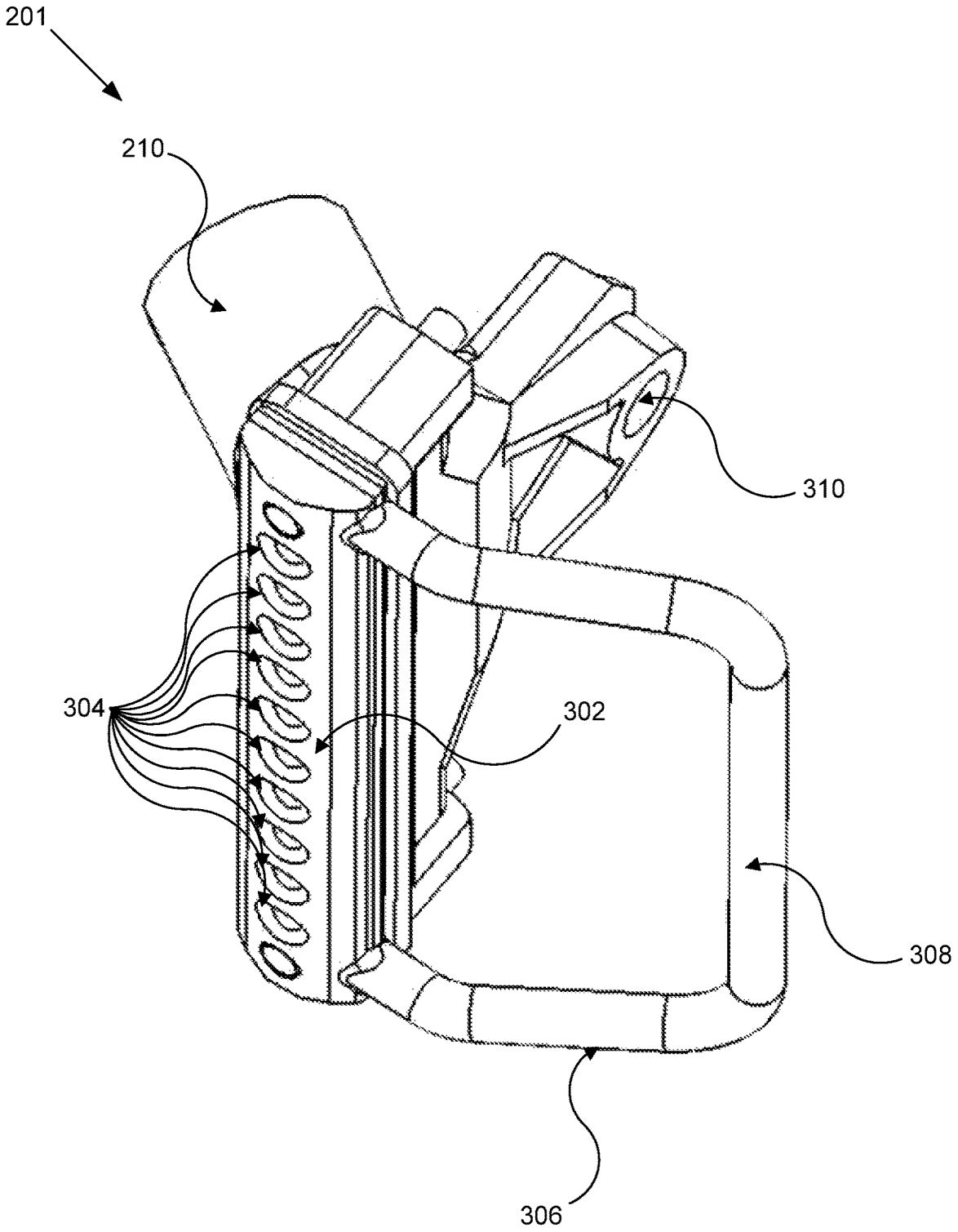
FIG. 3 is a perspective view diagram illustrating one embodiment of the extraction head.

FIG. 3 is a perspective view diagram illustrating one embodiment of the extraction head 201. The extraction head 201, or vacuum head, is shown here for removing liquid from fabric such as carpet. The extraction head includes a base plate 302 with one or more openings which function as extraction nozzles 304 to remove the liquid from the fabric. The base plate 302 is elongated and may be coated with an anti-friction coating to more easily move through a carpeted surface. Examples of coatings suitable for use in the present disclosure include, but are not limited to, polytetraflouroethylene (PTFE). In a further embodiment, various components of the extraction head 201 may be formed of PTFE other low-friction polymers, metals, or composites.

Extending from the base plate 302 is a guide bar 306. The guide bar 306 extends "forward" from the base plate 302 to guide the extraction head 201 over objects in the carpeted surface. For example, because the guide bar 306 extends outward in front of the base plate 302, the guide bar will make contact with objects in the carpeted surface before the base plate 302 as the extraction head 201 moves through a carpeted surface. As depicted, the guide bar 306 is configured with a leading bar 308 positioned above the plane of the base plate 302. As such, as the leading bar 308 encounters a carpet transition bar, for example, the incline of the guide bar 306 will "ride" up the carpet transition bar and consequently lift the base plate 302 over the carpet transition bar. In other words, the guide bar 306 protects the base plate 302 and prevents the extraction head 201 from catching on objects in the carpeted surface.

As discussed above, the extraction head 201 also includes the outlet 210. The outlet 210 is fluidly coupled with the plurality of extraction nozzles 304, and configured to attach with a hose that connects with the vacuum chamber described above with reference to FIG. 2. Also depicted here is a mounting point 310 for connecting the extraction head 201 with the rotary head of FIG. 2. The mounting point 310, in one embodiment, is an aperture through which a bolt or other fastening device may pass to secure the extraction head 201 to the rotary head.

Figure 4:
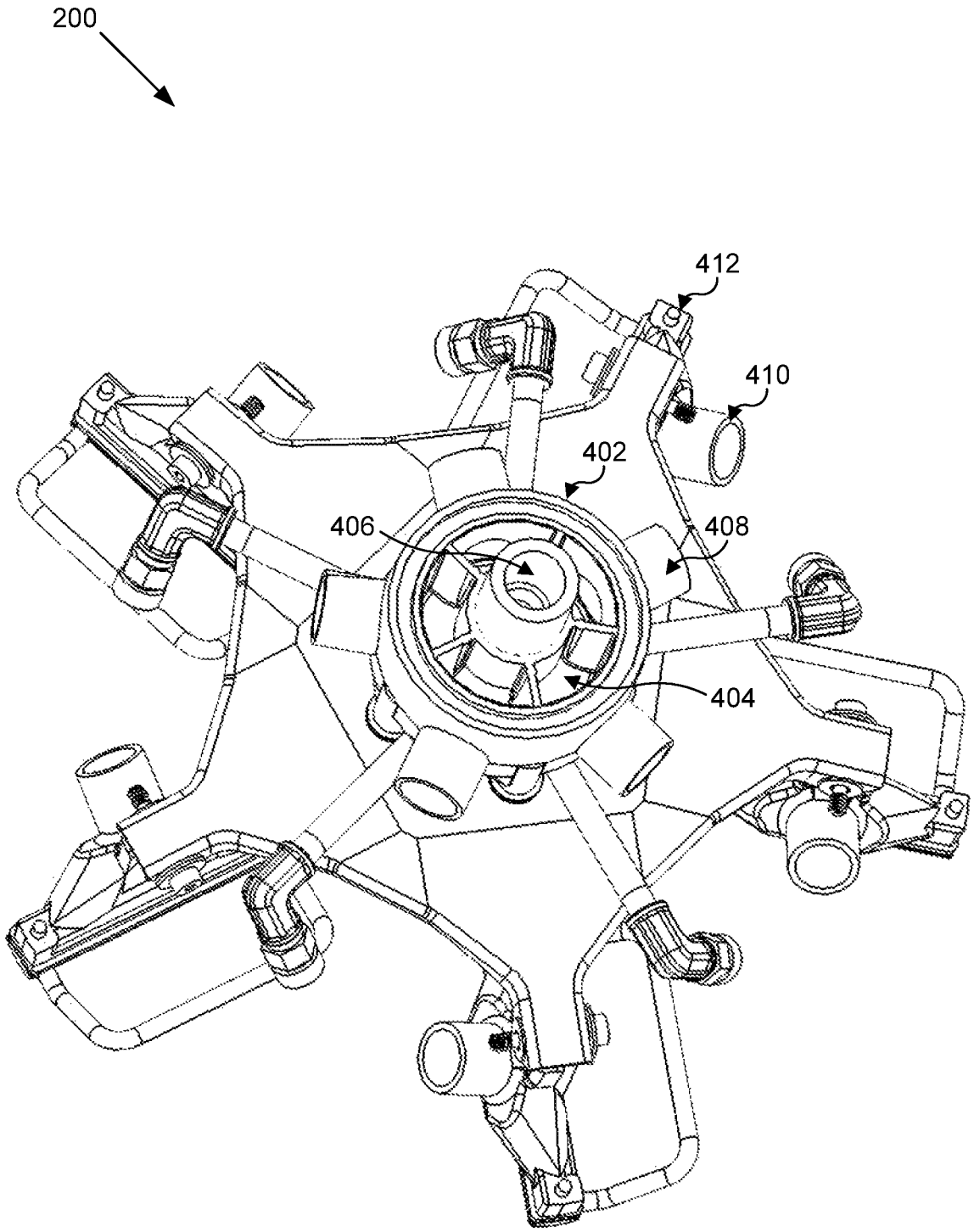
FIG. 4 is a perspective view diagram illustrating another embodiment of the rotary head.

FIG. 4 is a perspective view diagram illustrating another embodiment of the rotary head 200. The rotary head 200 is driven by a hollow driveshaft disposed between the gearbox and the rotary head 200. The driveshaft transfers the rotary force from the rotary motor, via the gearbox, to the rotary head 200 so that the rotary head 200 rotates about the driveshaft. The driveshaft connects to the rotary head 200 at the center of the hub 402.

The hub 402 includes, in this embodiment, multiple vacuum chambers 404 positioned radially around a center channel 406. Each of the vacuum chambers 404 is fluidly coupled with an inlet 408 and the evacuation tank 108 of FIG. 1. As such, a partial vacuum applied to the evacuation tank 108 causes a partial vacuum in the vacuum chambers 404 which thereby draws liquid through a hose connecting the inlet 408 to the outlet 410 of an extraction head 412.

Figure 5:
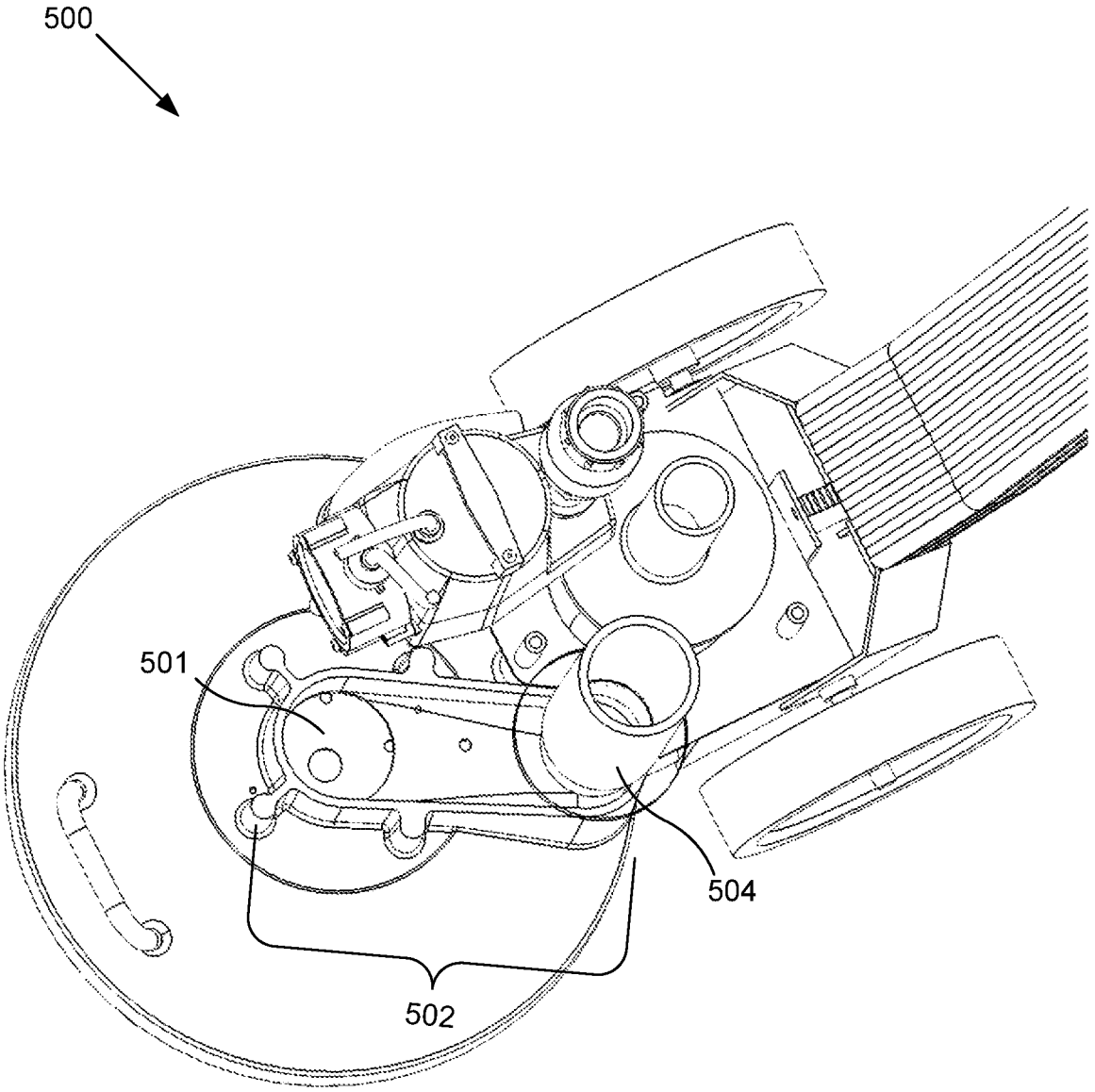
FIG. 5 is a perspective view diagram illustrating one embodiment of a vacuum path of the machine.
Figure 6:
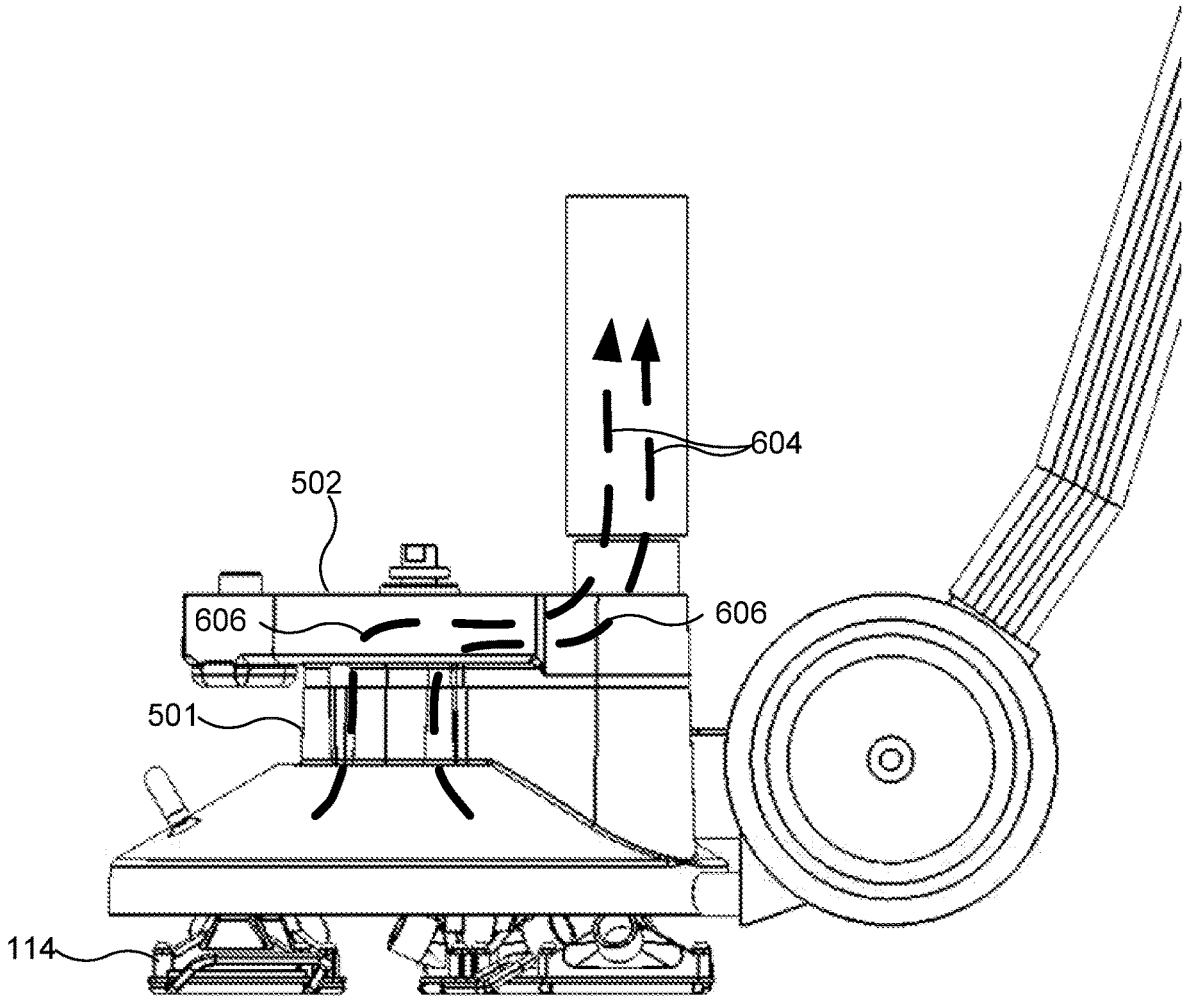
FIG. 6 is a side view diagram illustrating another embodiment of the vacuum path.

Referring jointly now to FIGS. 5 and 6, FIG. 5 is a perspective view diagram illustrating one embodiment of a vacuum path of the machine 500, and FIG. 6 is a side view diagram illustrating another embodiment of the vacuum path. As used herein, the term "vacuum path" refers to the pathway along which air and extracted fluid move under when a partial vacuum is introduced in the evacuation tank. The vacuum path, as described above with reference to the rotary head, starts at the extraction heads which are coupled with vacuum chambers 501 in the rotary head. FIG. 5 illustrates a plenum 502 coupled with the top of the rotary head and the vacuum riser 504. The plenum 502 forms a channel through which air and extracted fluid may pass. The plenum 502 is formed having smooth surfaces and rounded edges to minimize disruptions to the flow of air and extracted fluid.

The plenum 502 may be formed of a cast metal so that the interior surfaces that form the vacuum pathway are very smooth, as opposed to a machined part that may have ridges resulting from a milling process. Alternatively, the plenum may be formed of a smooth composite or rigid polymer material.

The vacuum path 604, as depicted in FIG. 6, rises from the extraction heads 201 to the vacuum chambers, up through the plenum 502, over to the vacuum riser 504, and then to the evacuation tank. In one embodiment, the length of the vacuum path 604 is in the range of between about 0.25 and 3 feet. In a further embodiment, the length of the vacuum path 604 is in the range of between about 0.75 and 2 feet. In yet another embodiment, the length of the vacuum path is in the range of between about 0.8 feet and 1 foot. The total height the extracted fluid is lifted via vacuum, therefore, is minimized and therefore less power is required to extract fluid from the floor, and extracted fluid performance increases.

The extraction capability of the machine 500 is increased by minimizing the length of the vacuum path 604, and the number of turns or obstacles in the vacuum path 604. As depicted, starting at the vacuum chamber 501, the vacuum path 604 includes two "turns" 606. As used herein, the term "turn" refers to a change in direction of the vacuum path 604. Therefore, the depicted vacuum path has a turn from a vertical to a horizontal path when entering the plenum 502, and a turn 606 from the plenum 502 to the vacuum riser 504. Beveled or sloped edges at the turns 606 will further reduce obstructions and improve air and extracted fluid flow. In other words, smoothing out the vacuum path 604 improves air and extracted fluid flow. As such the machine 500 is capable of extracting substantial amounts of cleaning solution from the floor. This greatly reduces the drying time of the floor.

Figure 7:
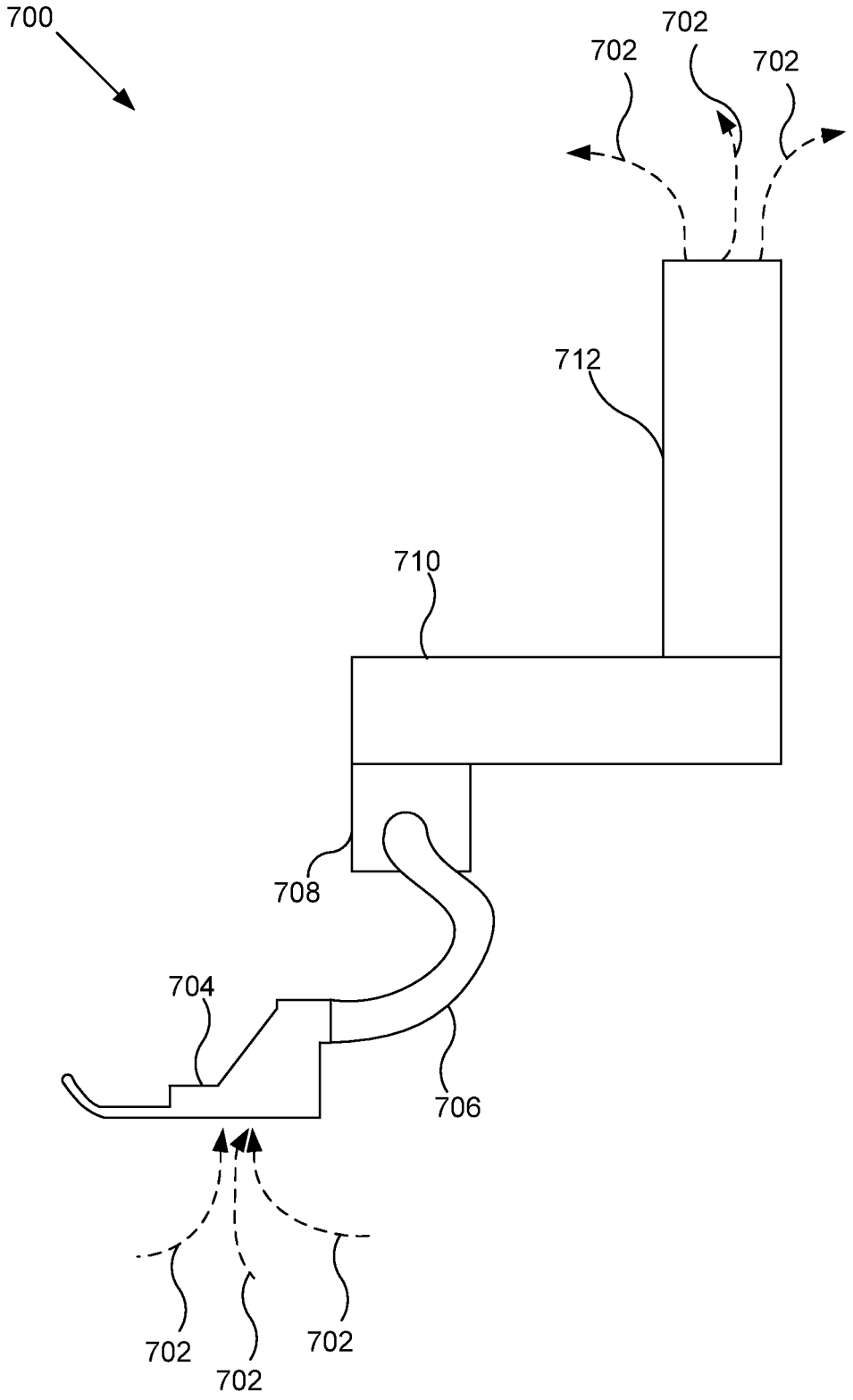
FIG. 7 is a side view diagram illustrating yet another embodiment of the vacuum path.

FIG. 7 is a side view diagram illustrating one embodiment of the vacuum path 700. The flow of air and liquid, as induced by the vacuum motor, is generally indicated here by arrows 702. For clarity, a single extraction head 704 is depicted, however, it is to be understood that multiple extraction heads 704 may be used. As described above, the extraction head 704 has multiple openings or nozzles in the floor facing surface of the extraction head for extracting liquid from the floor. In one example, the extraction head 704 includes 10 nozzles or openings, and the machine 100 includes 5 extraction heads 704. Each opening or aperture may have a diameter of about 5/32 inch. Alternatively, the size of the opening may be in the range of between about 1/32 and 11/32 inch.

Under the above example of a 5/32 inch opening, the total cross-sectional area for extracting fluid of 50 openings (10 openings per extraction head 704, and 5 extraction heads coupled with the rotating head of FIG. 2) is about 0.958 square inches. The fluid pathway length (or the distance fluid travels through the extraction head) is about 2.5 inches.

The extraction head 704 is fluidly coupled with an inlet tube 706 and the hub or rotating vacuum chamber 708. The inlet tube 706, in one example, is a smooth flexible tube with minimized obstructions. In other words, the inlet tube 706, in one embodiment, is not reinforced with ribbings that perturb and disrupt the air/liquid flow 702. In one embodiment, the cross-sectional area of all inlet tubes 706 is in the range of between about 2.5 and 3.5 square inches. In a further embodiment, the total cross-sectional area of the inlet tubes 706 is about 3.041 square inches. The fluid pathway length of each inlet tube 704 is about 5.5 inches.

The hub 708, as described above, transfers rotating power from a motor to the rotating head and also operates to transfer fluid from the floor to the waste tank. The hub 708 has a chamber that fluidly connects the inlet tubes 706 with the plenum. The chamber of the hub 708, in one embodiment, has a cross-sectional area in the range of between about 3.0 and 4.5 square inches. In a further embodiment, the cross-sectional area of the hub 708 is about 3.675 square inches. The fluid pathway length of the hub 708 is about 2.25 inches.

The plenum 710 fluidly connects the hub 708 to the riser 712 of standpipe. The plenum 710, in one embodiment is formed with an interior passageway having smooth interior surfaces so as to not disrupt or perturb the flow of air and liquid through the plenum 710. The cross-sectional surface area of the interior passageway of the plenum 710 is, in one example, in the range of between about 4.5 and 5.5 square inches. In a further example, the cross-sectional area of the interior passageway of the plenum 710 is about 5.089 square inches. The fluid pathway length of the plenum 710 is about 4.5 inches.

The riser 712 fluidly connects the plenum 710 with the waste tank described above with reference to FIG. 1. The riser 712 may be a hollow pipe having a diameter in the range of between about 2 and 3 inches. In a further example the riser 712 has a diameter of about 2.5 inches, and subsequently, an interior cross-sectional area of about 4.430 square inches. The riser 712 has a fluid pathway length of about 9.5 inches.

The total length of the fluid pathway or vacuum pathway 702 across the extraction head 704, inlet tube 706, hub 708, plenum 710, and riser 712 is about 24 inches. As described above, after the fluid enters the hub 708, the vacuum pathway has only two "turns" before reaching the waste tank. The first turn is a substantially 90 degree turn from the hub to the plenum 710. The second turn is a substantially 90 degree turn from the plenum to the riser 712. Therefore, the fluid is changes direction a maximum of about 180 degrees. This feature decreases the disruption of the fluid flow because turns or obstructions function to disrupt fluid flow and therefore decrease efficiency.

The ratio of cross-sectional area between the plenum 710 and the total cross-sectional areas of nozzles is about 5:1, while the ratios of the plenum 710 with the remaining components is in the range of between about 1.7:1 and 1:1. By maintaining a ratio between 1.7:1 and 1:1 between the plenum 710 and either the inlet tubes 706, hub 708, and riser 712 the fluid flow disruption is minimized because fluid is not being forced through substantially smaller pathways as it travels to the waste tank.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. A vacuum cleaner comprising:

a plurality of extraction heads, each extraction head having a plurality of apertures in a floor facing surface;

a rotary head comprising a plurality of vacuum chambers positioned radially around a center channel having a top outlet, wherein the plurality of extraction heads is mounted to the rotary head, wherein each of the plurality of vacuum chambers comprises an inlet coupled in fluid receiving communication with a respective one of the extraction heads, wherein each of the plurality of vacuum chambers operably rotates around the center channel;

an evacuation tank;

a non-rotating riser having a bottom inlet disposed along a horizontal plane from and non-concentric with the top outlet of the center channel, and a top inlet connecting to the evacuation tank;

a plenum laterally disposed to the floor when cleaning the floor and connecting the center channel top outlet and the non-rotating riser bottom inlet, such that the plurality of vacuum chambers, central channel, plenum, and non-rotating riser form a vacuum pathway; and a vacuum motor coupled to the non-rotating riser, wherein a vacuum created by the vacuum motor draws fluid from the apertures of the extraction heads through the vacuum pathway.

2. The vacuum cleaner of claim 1, wherein a cross-sectional area of the vacuum pathway is in the range of between 0.8 and 7 square inches.

3. The vacuum cleaner of claim 1, wherein a ratio of cross-sectional area of the vacuum pathway in the riser to a summed cross-sectional area of the plurality of apertures in the plurality of extraction heads is 5 to 1.

4. The vacuum cleaner of claim 1, wherein the vacuum pathway comprises at most two 90 degree bends.

5. The vacuum cleaner of claim 1, wherein the vacuum pathway changes direction no more than 180 degrees.

6. The vacuum cleaner of claim 1, wherein the vacuum pathway is between 0.25 and 3.0 feet in length.

7. The vacuum cleaner of claim 1, wherein the vacuum pathway is between 0.75 and 2.0 feet in length.

8. The vacuum cleaner of claim 1, wherein the distance is a fluid pathway distance between the plurality of vacuum chambers and the non-rotating riser, wherein the distance is 4.5 inches.

9. A vacuum cleaner for cleaning a floor comprising:

a plurality of extraction heads, each extraction head having a plurality of apertures in a floor facing surface;

a rotary head comprising a top outlet and a plurality of vacuum chambers positioned radially around a center channel in fluid connection with the top outlet, wherein the plurality of extraction heads is mounted to the rotary head, wherein each of the plurality of vacuum chambers comprises an inlet coupled in fluid receiving communication with a respective one of the extraction heads, wherein each of the plurality of vacuum chambers operably rotates around the center channel;

an extraction tank;

a riser capable of connecting to the extraction tank and having a bottom inlet disposed laterally from the top outlet; and a vacuum pathway coupled with and disposed between the plurality of extraction heads and the extraction tank through the riser, wherein the vacuum pathway comprises tubes coupled with and disposed between the extraction heads and the plurality of vacuum chambers of the rotary head, the plurality of vacuum chambers connecting to the rotary head top outlet, the top outlet coupled with a plenum chamber disposed laterally to the floor when cleaning the floor and between the plurality of vacuum chambers and the riser, the plenum chamber coupled with the riser bottom inlet;

wherein a ratio of the cross-sectional area of the vacuum pathway in the plenum chamber to a cross-sectional area of one of the tube, the plurality of vacuum chambers, or the riser is between 1.7:1 and 1:1.

10. The vacuum cleaner of claim 9, wherein a ratio of a cross-sectional area of the vacuum pathway in the plenum chamber to a summed cross-sectional area of the plurality of apertures in the plurality of extraction heads is 5 to 1.

11. The vacuum cleaner of claim 9, wherein the vacuum pathway between the vacuum chamber and the riser comprises at most two 90° bends.

12. The vacuum cleaner of claim 9, wherein a cross-sectional area of the vacuum pathway is between 0.8 and 7 square inches.

13. The vacuum cleaner of claim 9, wherein internal surfaces of the vacuum pathway are smooth and substantially continuous.

14. The vacuum cleaner of claim 9, wherein the vacuum pathway is between 0.25 and 3.0 feet in length.

15. The vacuum cleaner of claim 9, wherein the vacuum pathway is between 0.75 and 2.0 feet in length.

16. The vacuum cleaner of claim 9, wherein the vacuum pathway is 1 foot in length.

17. The vacuum cleaner of claim 9, wherein the vacuum pathway changes direction no more than 180 degrees.

18. A vacuum cleaner for cleaning a floor, comprising:

a rotary head coupled to a plurality of extraction heads, each extraction head having a plurality of apertures in a floor facing surface;

an evacuation tank;

a vacuum motor, wherein the vacuum motor expels suctioned fluid into the evacuation tank;

a riser coupled to the vacuum motor, the riser having a bottom inlet; and a vacuum pathway disposed between the extraction heads and the riser, wherein the vacuum pathway comprises tubes coupled with and disposed between the extraction heads and a plurality of vacuum chambers positioned radially around a center channel such that the plurality of vacuum chambers is concentric with the center channel, the center channel having a top outlet disposed laterally from the riser bottom inlet, and a plenum chamber disposed laterally and coupled with the riser, and wherein a ratio of a cross-sectional area of the vacuum pathway in the plenum chamber to a summed cross-sectional area of the plurality of apertures in the extraction heads about 5 to 1.

* * * * *